United States Patent [19]

Howard et al.

[11] Patent Number: 4,746,017

[45] Date of Patent: May 24, 1988

[54] SAFETY CONTAINER FOR GLASS VIALS

[75] Inventors: David S. Howard, Middlesex, N.J.; Michael S. Roehm, Evansville, Ind.

[73] Assignee: Bristol-Myers Company, New York, N.Y.

[21] Appl. No.: 86,348

[22] Filed: Aug. 18, 1987

[51] Int. Cl.[4] ..... B65D 81/02; B65D 23/08

[52] U.S. Cl. ..... 206/438; 206/807; 206/828; 206/521; 220/445; 604/111; 604/404; 215/249; 215/DIG. 3; 215/12.1; 215/2

[58] Field of Search ..... 215/12.1 (U.S. only), 215/247, 249, DIG. 3, 365, 10, 2; 206/438, 828, 807, 521, 592; 220/468, 445, 448; 604/111, 404; 150/52 R

[56] References Cited

U.S. PATENT DOCUMENTS

| | | | |
|---|---|---|---|
| 1,063,351 | 6/1913 | Hyatt | 215/12.1 |
| 1,131,650 | 3/1915 | Alexander | 220/448 |
| 1,364,774 | 1/1921 | Macera | 215/12.1 |
| 1,424,667 | 8/1922 | Murch | 215/12.1 |
| 1,868,773 | 7/1932 | Staake | 215/12.1 X |
| 1,945,126 | 1/1934 | Upjohn | 215/12.1 |
| 1,996,674 | 4/1935 | Cross | 215/12.1 |
| 2,036,876 | 4/1936 | Kraft | 215/12.1 X |
| 2,283,867 | 5/1942 | Flosdorf et al. | 206/438 X |
| 2,568,371 | 9/1951 | Seaver | 215/12.1 |
| 2,575,283 | 11/1951 | Menrath | 215/12.1 |
| 2,597,715 | 5/1952 | Erikson | 215/12.1 X |
| 2,857,067 | 10/1958 | Lehmans-Leroy | 215/12.1 X |
| 3,379,326 | 4/1968 | Anderson | 215/DIG. 3 X |
| 3,565,280 | 2/1971 | Rausing | 220/453 |
| 3,613,761 | 10/1971 | Moody | 215/12.1 X |
| 3,770,155 | 11/1973 | Novitch | 215/DIG. 3 X |
| 4,245,685 | 1/1981 | Nemitz et al. | 215/12.1 X |
| 4,260,065 | 4/1981 | Van Cromvoirt | 215/2 |

FOREIGN PATENT DOCUMENTS

| | | | |
|---|---|---|---|
| 650174 | 10/1962 | Canada | 206/438 |
| 1045952 | 10/1966 | United Kingdom | 206/438 |

*Primary Examiner*—William Price
*Assistant Examiner*—Sue A. Weaver
*Attorney, Agent, or Firm*—Robert H. Ultoh

[57] ABSTRACT

A protective safety container for encasing toxic drug filled glass vials is disclosed. The container includes a molded plastic body that is shaped to conform to the shape of a vial to be protected. A plurality of spaced longitudinal ribs are formed on the inner surface of the container body that act to engage the vial and hold it firmly in position, and also form a cushioning air space between the vial and the container. A molded plastic annular base is adapted to be snap fitted into the body such that the vial cannot be easily removed once it is secured within the container. Disposed in the top of the container is a small aperture having a frangible disk disposed therein. The disk may be removed so that a hypodermic needle may be inserted into a stopper in the vial to withdraw the vial's contents. The aperture is too small, however, to permit removal of the stopper itself. All of these features combine to provide a protective container for a glass vial which will prevent the intentional or accidental discharge of the vial's contents to the surrounding area.

6 Claims, 1 Drawing Sheet

FIG 1
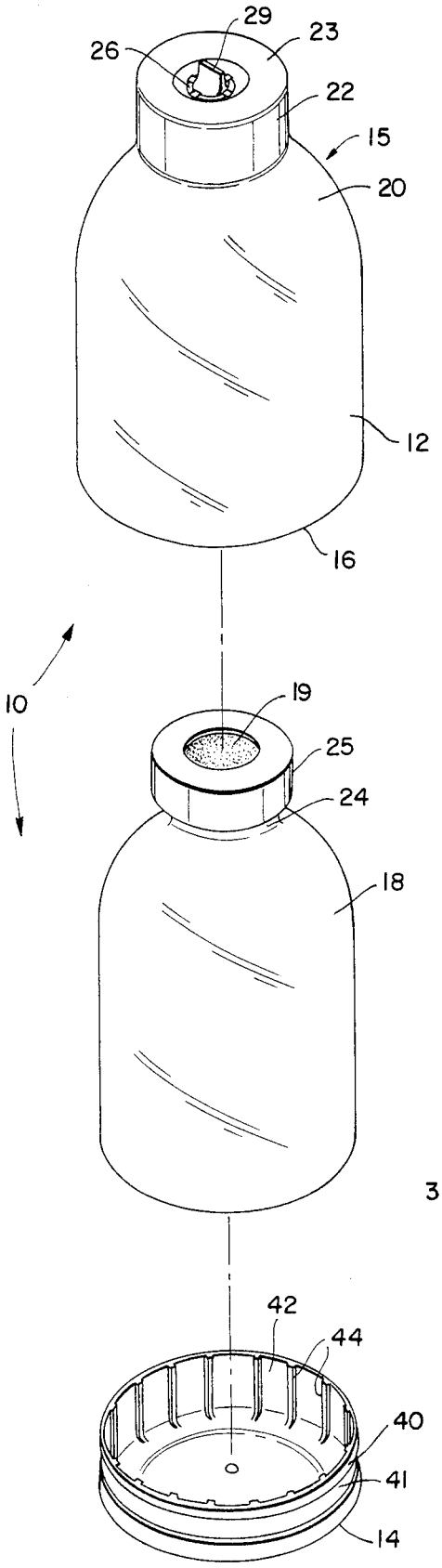
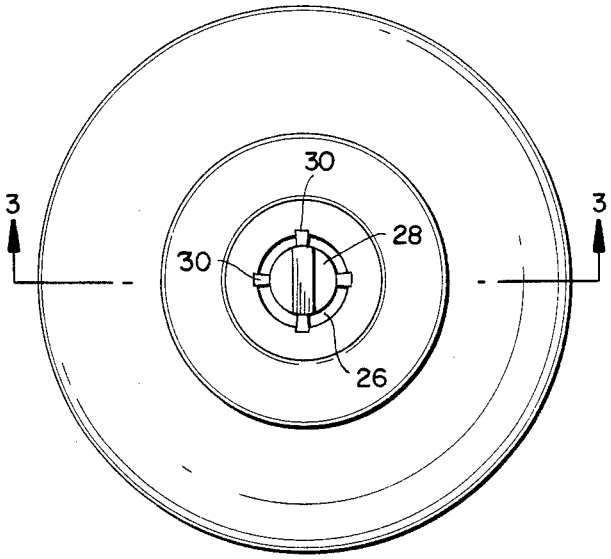
FIG 2
FIG 3
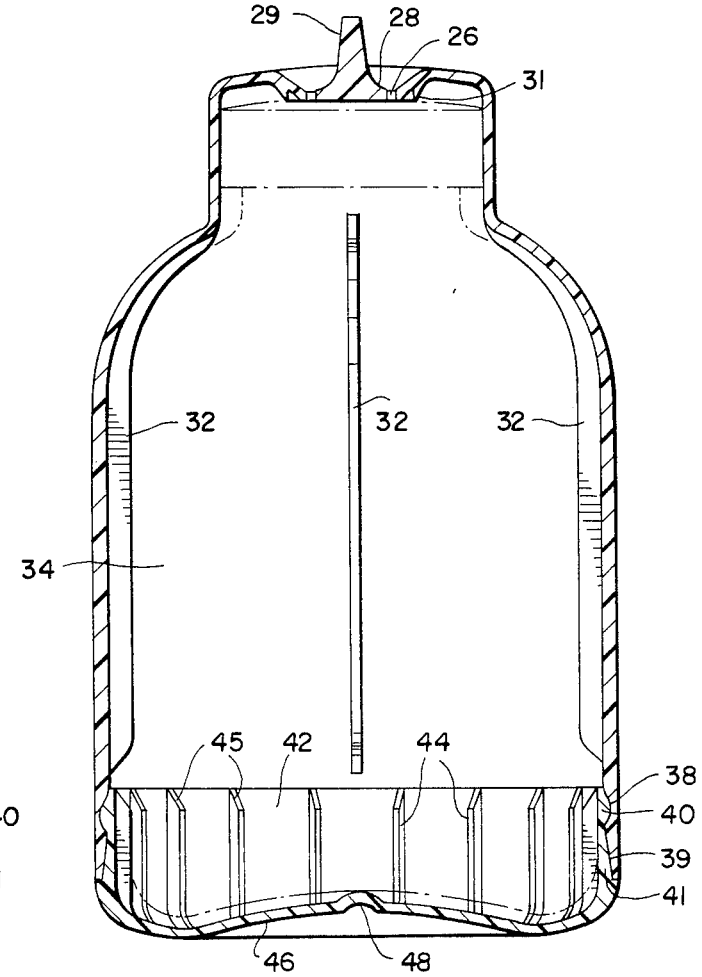

SAFETY CONTAINER FOR GLASS VIALS

BACKGROUND OF THE INVENTION

The present invention relates to a plastic safety container for medication filled glass vials. Often, glass vials are utilized to contain toxic drugs, or other medication. Usually, the vials are sealed at one end by a rubber stopper that can be penetrated by a hypodermic needle for access to the vial's contents.

A serious problem with the use of such glass vials is the great probability that the vial will be broken, and that the surrounding area will be contaminated by the drug. To date, no simple inexpensive solution to this problem has been devised. Although it has long been generally known to utilize safety containers to house and protect fragile or breakable receptacles, usually the receptacles have to be removed from the containers to gain access to their contents, and removal of the receptacle from the container is easily accomplished. In the case of toxic drug filled glass vials, this is highly undesirable, since the very act of removing the vial from the safety container presents a perfect opportunity to break the vial and discharge its toxic contents to the surrounding area.

SUMMARY OF THE INVENTION

It is therefore an object of the present invention to provide a simple inexpensive protective safety container for a glass vial which will protect the vial from breakage and tampering, and allow access to the contents of the vial without removing the vial from the container.

It is a further object of the invention to provide a protective safety container for a glass vial which is formed of a simple two piece molded construction, and will securely enclose a glass vial without the use of glue, or other sealing means.

These and other objects of the invention are attained through the provision of a generally cylindrically shaped molded plastic body that is open at its bottom end, has a plurality of spaced longitudinal ribs molded on the inner surface thereof, and has a small aperture disposed in the center of the top thereof. The body is shaped to conform to a glass vial to be protected so that the longitudinal ribs will engage the outer surface of the vial, and a protective air space will be formed between the inner surface of the body and the outer surface of the vial.

A frangible disk shaped closure member is disposed in the aperture in the top of the body, and includes a vertically extending tab for easy removal of the frangible disk. The aperture is small enough that a rubber stopper disposed in the neck of the vial cannot be removed, however, access to the contents of the vial may be obtained with a needle that is inserted through the aperture and stopper after removal of the frangible closure.

Molded in the inner surface of the body near its bottom end is a horizontally inwardly extending circular groove. This groove cooperates with an outwardly extending rib disposed on the outer periphery of an annular base so that the base can be snap fitted into the open bottom end of the body. The interior of the base also includes a plurality of spaced vertically extending ribs for engaging the outer surface of the glass vial.

When a glass vial is inserted in the open bottom of the body, and the annular base is snapped into the bottom, a sealed container is formed which holds the vial snugly in position, and protects the same from breakage or tampering. Once the base is snapped into position, the vial acts to hold the cooperating surfaces of the body and base together, thus making it very difficult to remove the base, and obtain access to the vial. In this manner, the present invention acts as a semi-permanent tamper resistant protective container for glass vials which allows access to the vial's contents without removal of the vial from the container.

BRIEF DESCRIPTION OF THE DRAWINGS

The foregoing objects, features and advantages of the invention will become apparent from a consideration of the following detailed description of a preferred embodiment thereof, taken in conjunction with the accompanying drawings, in which:

FIG. 1 is an exploded perspective view of the present invention with a glass vial to be contained;

FIG. 2 is a top plan view of the present invention; and,

FIG. 3 is a cross sectional front view of the assembled present invention taken along line 3—3 of FIG. 2.

DESCRIPTION OF THE PREFERRED EMBODIMENT

Turning now to a more detailed consideration of the present invention, there is illustrated in FIG. 1 an exploded form, a protective safety container generally illustrated at 10 and including a generally cylindrical shaped body 12, and an annular base 14. The body 12 includes a top portion 15, and an open bottom 16 which is shown in position to receive a medication filled glass vial 18 having a rubber stopper 19 disposed in the top thereof.

As shown, the body 12 is generally shaped to conform to the shape of vial 18, and includes an inwardly tapered portion 20 which leads to a narrow cylindrical neck 22 at top portion 15 that extends inwardly to form a top wall 23 and is adapted to enclose a neck 24 and cap 25 of vial 18. Disposed in the center of the top wall 23, is an aperture 26 which is closed off by a frangible sealing disk 28 having a tab 29 for removal of the same. As best illustrated in FIG. 2, disk 28 is held in aperture 26 by a plurality of spaced legs 30.

An inner sealing flange 31 surrounds aperture 26 and engages the top of a vial disposed in the container such that a sealed air space is created between the vial and the container wall. As illustrated in FIG. 3, a plurality of longitudinal ribs 32 are molded on the interior surface 34 of body portion 12, and extend vertically for a substantial length of the same. These ribs are shaped to engage the outer surface of vial 18, and thereby serve to hold the vial snugly in position within body 12. In addition, the ribs, along with sealing flange 31 create an air space between the vial and body 12 that acts as a further cushioning means for vial 18.

As illustrated in FIG. 3, a horizontal annular groove 38 is molded into the inner surface 34 of body 12 near bottom 16. In addition, wall 34 includes a tapered portion 39 at bottom 16. Annular groove 38 and tapered portion 39 cooperate with a corresponding outwardly facing annular rib 40 and a tapered portion 41 that are formed along the exterior periphery of annular base 14, so that a snap fit is provided when body 12 and base 14 are connected together. The tapered portions 39 and 41 insure an easy insertion of base 14 into body 12, while groove 38 and rib 40 make removal of base 14 difficult once it is inserted into body 12.

As shown in FIGS. 1 and 3, base 14 includes an interior wall surface 42 having a plurality of spaced longitudinal ribs 44 formed thereon. These ribs, like ribs 32 of body 12, engage the exterior surface of a vial to further secure the vial in position when body 12 and base 14 are snapped together. The ribs include tapered ends 45 to help guide base 14 into position over the bottom of a vial. Base 14 also includes a concave bottom wall 46 that has a raised center area 48 which is shaped to engage the bottom surface of vial 18. This raised center area serves to further insure that vial 18 will be snugly held within container 10 when base 14 is snapped into body 12 by urging the vial toward the top of container 10.

In the use of the present invention, a glass vial is inserted into body 12, and base 14 is snapped into open bottom 16. The action of horizontal groove 38 and rib 40, combined with the presence of the glass vial inside container 10, will make it very difficult to remove base 14. This will discourage anyone from opening the safety container, exposing the vial to the open and risking not only breakage of the same, but possible contamination of the surrounding area by a toxic drug in the vial.

When it is necessary to remove the contents of the vial, frangible sealing disk 28 is removed from aperture 26 by tab 29, thus exposing stopper 19 in the mouth of the vial. Since aperture 26 is smaller in diameter than the stopper 19, the stopper cannot be removed; however, the contents of the vial may be withdrawn through use of a hypodermic needle inserted through the stopper. This feature of the present invention again serves to prevent the inadvertent spillage or discharge of the vial's contents to the surrounding area.

It may thus be seen that the present invention provides a simple inexpensive protective safety container that acts to prevent a medication filled glass vial from being broken or tampered with, yet allows access to the contents of the vial.

Although the invention has been illustrated in terms of a preferred embodiment, it will be understood that numerous variations and modifications can be made by those of skill in the art without departing from the true spirit and scope of the inventive concept as set forth in the following claims.

What is claimed is:

1. A protective container for encasing medication filled glass vials comprising:

an annular base;

a generally cylindrically shaped body having a top, an open bottom, and a plurality of spaced longitudinal ribs disposed on the interior thereof, said body being shaped to generally conform to the exterior of a glass vial to be protected so that said longitudinal ribs will engage the vial and hold it firmly in position while providing an air cushion between the vial and said protective container to further protect the vial;

means disposed at said bottom of said body to receive said annular base in a snap fit tamper resistant manner; and an aperture disposed at said top of said body to permit access to the contents of a vial held in said protective container without disturbing the protective function of said container, said aperture having a frangible sealing means disposed therein, whereby, when a glass vial is inserted in said body, and said annular base is snapped into said body, the glass vial will be protected from breakage or tampering, but the contents of the vial may be accessed by removing said frangible means and inserting a syringe inserted through said aperture and a stopper disposed in the top of the vial.

2. The protective container of claim 1 wherein said annular base includes a plurality of spaced longitudinal ribs disposed along an inner wall thereof which act to further secure a vial in position when the base is snapped into the body.

3. The protective container of claim 2, wherein said annular base also includes a floor having a raised center area for engaging the bottom of a vial and further securing the same in the container.

4. The protective container of claim 1 wherein said frangible means includes a pull tab for easy removal of the frangible means from the top of the container body.

5. The protective container of claim 4 wherein, said aperture is smaller in diameter than the diameter of a rubber stopper in the top of said vial wherein, said stopper cannot be removed from the vial through said aperture, but the contents of said vial may be removed with a needle inserted through said aperture and the stopper.

6. The protective container of claim 1, wherein said means to receive said base in a snap fit manner comprises a horizontal annular groove along an inner surface of the body near said open bottom, and a cooperating annular rib disposed along an outer peripheral surface of said annular base.

* * * * *